United States Patent [19]

Nee

[11] Patent Number: 4,531,445

[45] Date of Patent: Jul. 30, 1985

[54] PROJECTILE LAUNCHER

[75] Inventor: Michael A. Nee, San Dimas, Calif.

[73] Assignee: N.I. Industries, Inc., Los Angeles, Calif.

[21] Appl. No.: 548,977

[22] Filed: Nov. 7, 1983

[51] Int. Cl.[3] ..... F41F 3/04

[52] U.S. Cl. ..... 89/1.813; 89/1.816

[58] Field of Search ..... 89/1.816, 1.813, 1.812, 89/1.8, 1.7, 1.705, 1.703

[56] References Cited

U.S. PATENT DOCUMENTS

| | | | |
|---|---|---|---|
| 3,122,059 | 2/1964 | Choate et al. | 89/1.813 |
| 3,256,777 | 6/1966 | Choate et al. | 89/1.813 |
| 3,371,578 | 3/1968 | Choate et al. | 89/1.813 |
| 3,677,131 | 7/1972 | Nee | 89/1.703 |
| 3,745,876 | 7/1973 | Rocha | 89/1.816 X |
| 3,960,054 | 6/1976 | Looger | 89/1.816 |
| 4,417,498 | 11/1983 | Dissmeyer et al. | 89/1.814 |

*Primary Examiner*—David H. Brown

[57] ABSTRACT

A projectile launcher has first and second telescopingly connected sections enabling it to be extended into an operative state when it is to be discharged. The firing mechanism has a firing member carried by the first section which extends into a housing on the second section. The rear of the housing is a chamber for a pivoted trigger having a forward portion of greater length than its rearward portion and underlying a boot covered port. A rotary sear in the chamber has first and second arcuately spaced shoulders the second of which is engaged and held by the rearward trigger portion under the influence of a spring. When but a short further relative movement between the sections is required to fully extend the launcher, the first sear shoulder engages and pulls forward the firing member thus to cock the firing mechanism when the launcher is fully extended, the firing spring then exerting a substantial force against the first shoulder. While the difference in lengths of the trigger portion offers the user a theoretical mechanical advantage, the place where the effective pressure of the fingers applied thereagainst through the boot is an uncertain and variable factor causing inaccuracy in use due to the resulting variations in the force required to pull the trigger. The radial distances of the sear shoulders are such that the force exerted by the second sear shoulder is so reduced that said factor is minimized to an extent enabling the use of such launchers to be attended with increased accuracy.

2 Claims, 18 Drawing Figures

66
65
67
64
57
68
59
60A
58
32A
63
60B
70
70A
50
51A
49
57A
69
51
50B
41B
33
41A
40
60
61
62
31
50B
33
50
72
51A
71
73
74
70

PROJECTILE LAUNCHER

BACKGROUND REFERENCE

U.S. Pat. No. 3,677,131.

BACKGROUND OF THE INVENTION

Projectile launchers of the type that have breech and muzzle sections telescopingly connected to enable them to be carried in a shortened state and extended into a lengthened operative state when their use is required have proved to be effective weapons.

Such launchers have firing mechanisms that require a firing pin and firing spring close to the rear end of the breech section and a trigger carried by the muzzle section with a connection between the trigger and firing pin that enables the launcher to be extended with the firing mechanism then becoming operative. The force exerted by the firing spring through the firing mechanism against the trigger must be overcome to disengage the trigger from the sear and the "pounds of pull" required to release the firing mechanism must be neither too light nor too heavy. It is, of course, well recognized that in the case of hand held weapons that their trigger be operable without being the cause of such movement of a properly sighted weapon as to cause inaccuracy when the firing pin is released. It will be appreciated that problems affecting accuracy become of ever increasing importance as target ranges increase.

One cause of such movement is the lack of a crisp release occurring when there is what is often termed "creep" while another cause is the requirement that excessive force is needed to pull a trigger so that "pounds of pull", lack of variations thereof and "creep" are important to a proper firing mechanism.

Yet another factor relating to accuracy is introduced where, as in the case of launchers, the length of the connection between the trigger and firing pin is substantial for any connection the operation of which is attended by lift or drag has an effect comparable to "creep" even though ensuring proper ignition of the projectile.

An additional problem occurs when the launchers are of a type disposable once used as successively used launchers must have substantially identical trigger "pull" characteristics. The permitted range of "pounds of pull" is established by the government ordering disposable launchers, commonly a six to eight pound range. Launchers are inspected and subjected to certain tests before being accepted and one such test is whether or not trigger "pull" is within the specified range.

In U.S. Pat. No. 3,677,131 a launcher of the type under consideration has its firing mechanism include a rigid firing member consisting of a main portion with its rear end, the firing pin and a forward extension. The firing member extends freely into a housing on the muzzle section, the rear portion of which is the trigger chamber and has a boot covered port.

A trigger pivotally mounted in the chamber has a relatively long forward portion underlying the port and a relatively short rearward portion under the influence of a spring depressing that portion and yieldably holding the forward portion sufficiently close to the boot to enable it to be depressed by the force of the pressure of the fingers applied thereto through the boot.

A rotatable sear in the chamber has first and second arcuately spaced shoulders of which the second is engaged by the rearward trigger portion and thereby held from turning in a first direction until the trigger is actuated to effect its disengagement from the second shoulder.

When such a launcher requires but a short further relative movement between its sections to be fully extended, the second sear shoulder engages a shoulder of the firing member established by the junction of its main part and its extension, and pulls the firing member forwardly so that when the launcher is fully extended, the firing spring is tensioned. The firing member is slidably supported and slidably held in a fixed channel.

When the firing mechanism is thus cocked, the firing spring exerts through the firing member a substantial force against the first sear shoulder which force is exerted against the rearwardly extending portion of the trigger, thirteen pounds for one example. The ratio between the forward and rearwardly extending portions, in the case of the above referred to patent, is approximately 2:1 as a consequence of which a substantial mechanical advantage is theoretically available such as to enable the required trigger pull to be in the order of 6.5 pounds.

While the firing mechanism above described provided a suitably crisp release and avoided lifting or dragging of the firing member, it was found that in fact the trigger pull was both too harsh and too variable to enable consistent accuracy to be attained.

THE PRESENT INVENTION

The general objective of the present invention is to provide trigger operated firing mechanisms for extendable launchers of the type employing a rotatable sear with the mechanism ensuring that the force needed to operate the trigger of identical launchers is within a small, acceptable range.

It should be noted that extendable launchers of the type with which the invention is concerned are shoulder supported with the muzzle section held by one hand and the other hand so positioned that its fingers engage the boot and the pressure applied by them against the forward trigger portion is the trigger operating force. It has not been previously recognized that the application of such forces, particularly through a boot, is the cause of trigger operating forces being too large and variable. Where, lengthwise of forward trigger portion, the trigger operating force is actually applied is in fact an uncertain and variable factor and due to the difference in strength of the several fingers in engagement with the boot, the mechanical advantage that the trigger theoretically offers the user is seldom fully employed.

In accordance with the present invention, the general objective is attained by utilizing the rotary sear itself to provide a wanted reduction between the force exerted against the first shoulder and the force applied by the second sear shoulder against the rearward portion of the trigger with the reduction establishing the maximum force required to release the sear and with any mechanical advantages resulting by the application of forces to the forward trigger portion resulting in decreases in sear releasing forces to an acceptably small range.

PRIOR ART STATEMENT

The only prior art known to applicant that is relevant to the claims is U.S. Pat. No. 3,677,131 which has been previously discussed.

It will be noted that the rotary sear of that patent was intended to and did provide for the crisp release of the firing member. As the radial distance from the sear axis to both shoulders is the same the full force exerted by the firing spring was transmitted to the trigger. As a consequence, the "pounds of pull" required for trigger operation was usually too large and variable to enable the launcher to be held on target when trigger releasing force was applied.

BRIEF DESCRIPTION OF THE DRAWINGS

The accompanying drawings illustrate a preferred embodiment of the invention

THE PREFERRED EMBODIMENT OF THE INVENTION

The invention is disclosed as incorporated in a projectile launcher in accordance with U.S. Pat. No. 3,677,131 and such a launcher is first described with reference to its general construction even though many of the features thereof are not essential to the construction and functioning of the subsequently detailed firing mechanism.

Figure 1:
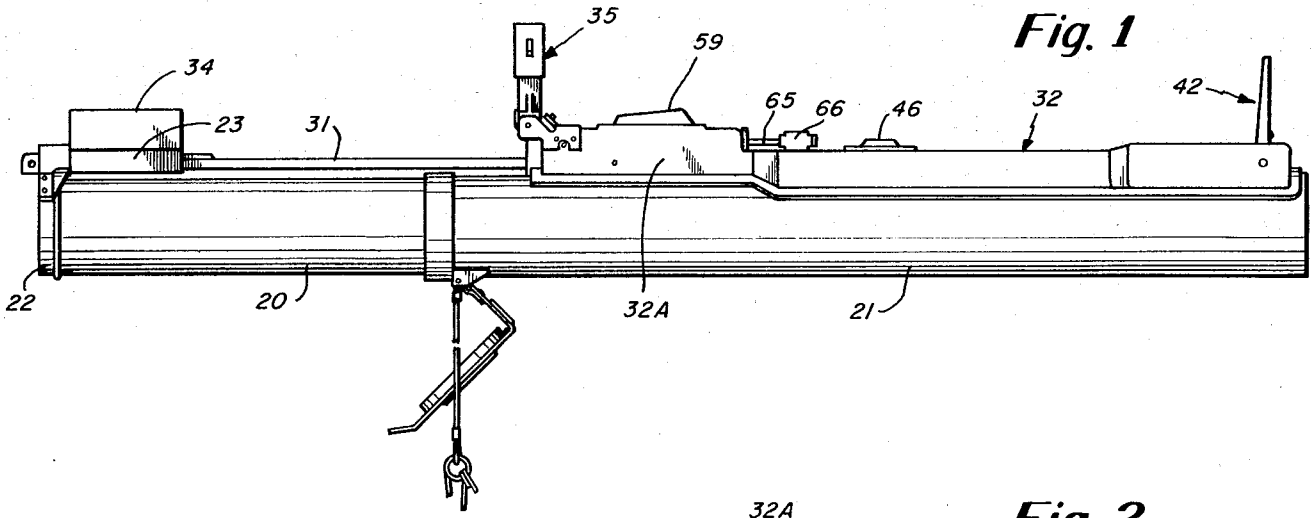
FIG. 1 is a side elevation of a rocket launcher in its extended operative state.
Figure 2:
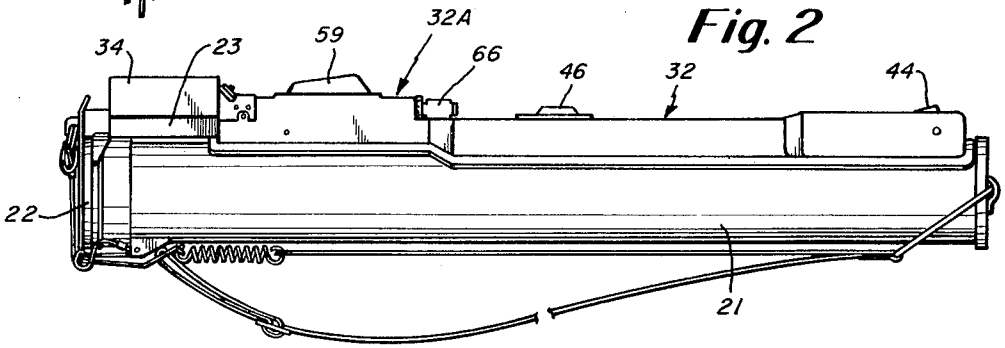
FIG. 2 is a like view but with the launcher in its shortened, inoperative state.

Such a launcher has first and second tubular sections with the first section 20 the breech section and a slidable fit in the second or muzzle section 21 thus to enable the launcher to be extended from its shortened, inoperative state shown in FIG. 2 into its extended, operative state illustrated by FIG. 1.

Figure 5:
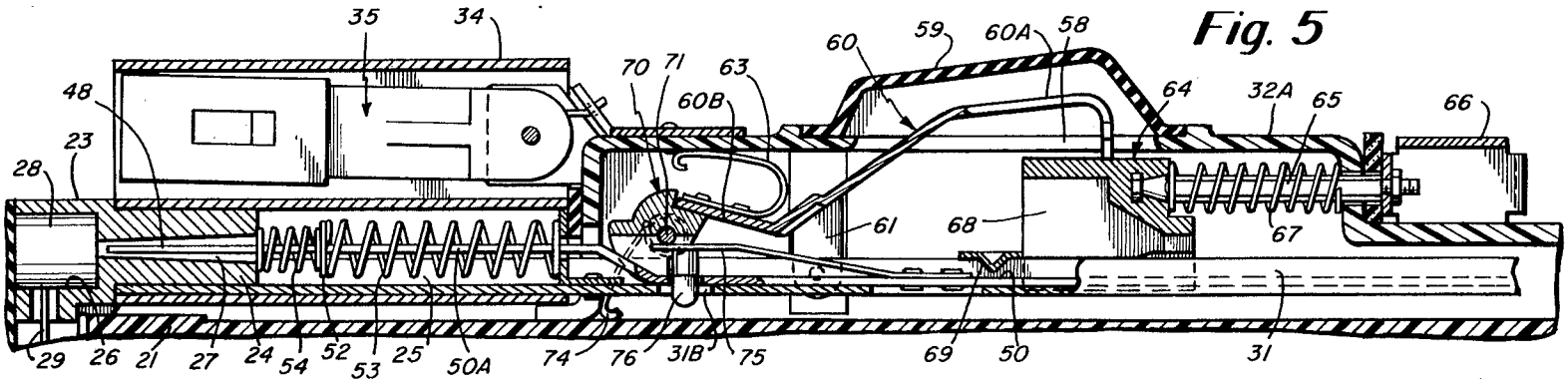
FIG. 5 is a like view of the rear portion of the mechanism.
Figures 6, 7, 8:
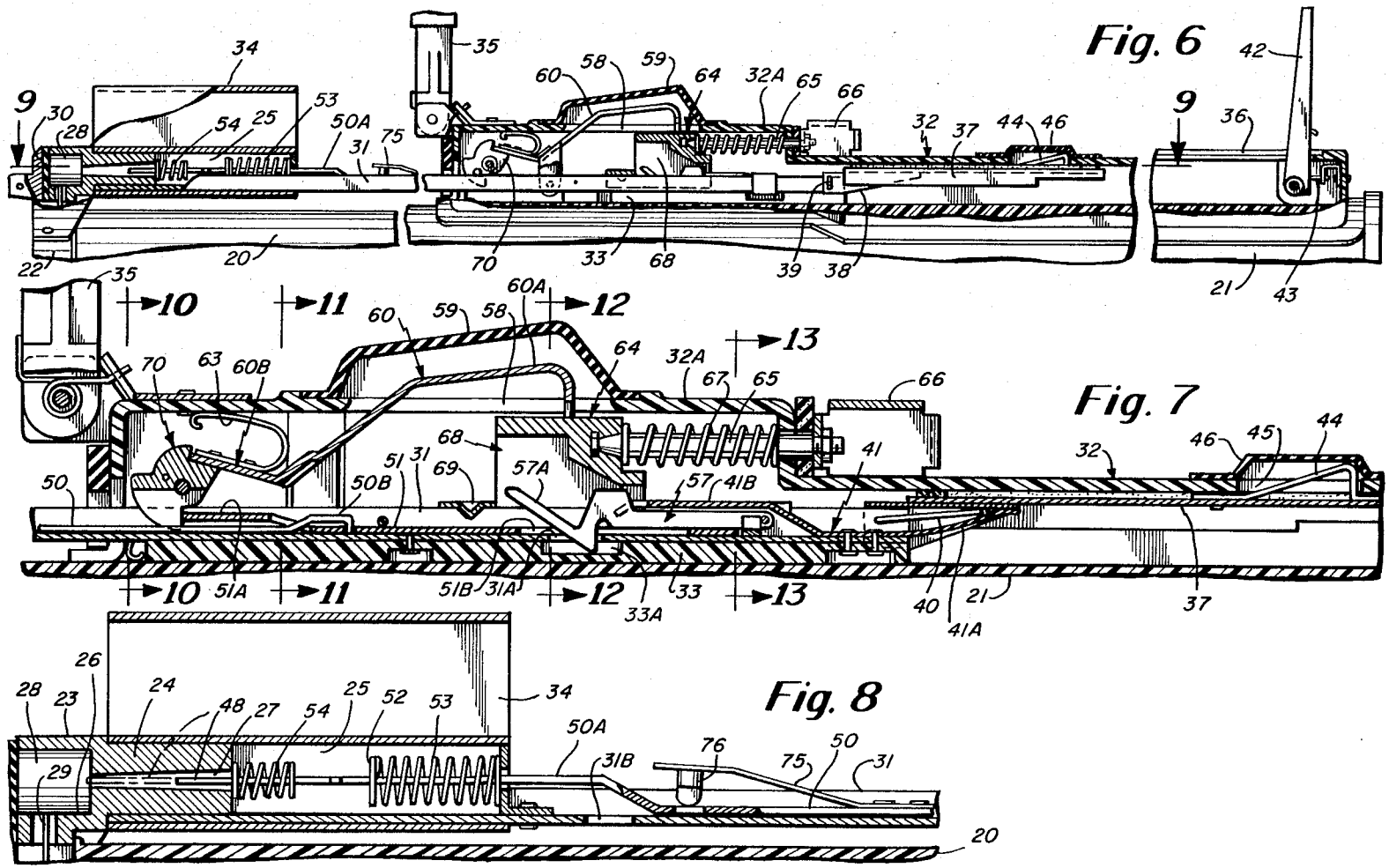
FIG. 6 is a view similar to FIG. 3, but with the launcher fully extended.
FIG. 7 is a view on an increase in scale, of the trigger and sear of the firing mechanism as positioned in FIG. 6.
FIG. 8 is a fragmentary view of the firing pin end of the firing mechanism as positioned in FIG. 6.

The breech end of the section 20 is provided with a collar 22 in support of a forwardly extending housing 23 which, see FIGS. 5 and 8, overlies the rear end of the muzzle section 21 when the launcher is in its shortened state. The housing is divided by a central partition 24 to establish a forward chamber 25 and a rearward chamber 26 with the partition 24 having a bore 27 effecting communication between the two chambers.

The chamber 26 accommodates the cap 28 of an igniter the tube 29 of which extends through a port in the section 20 where it is operatively connected to a projectile, not shown, confined in the breech section 20. The chamber 26 is closed by an end cap 30.

Figure 3:
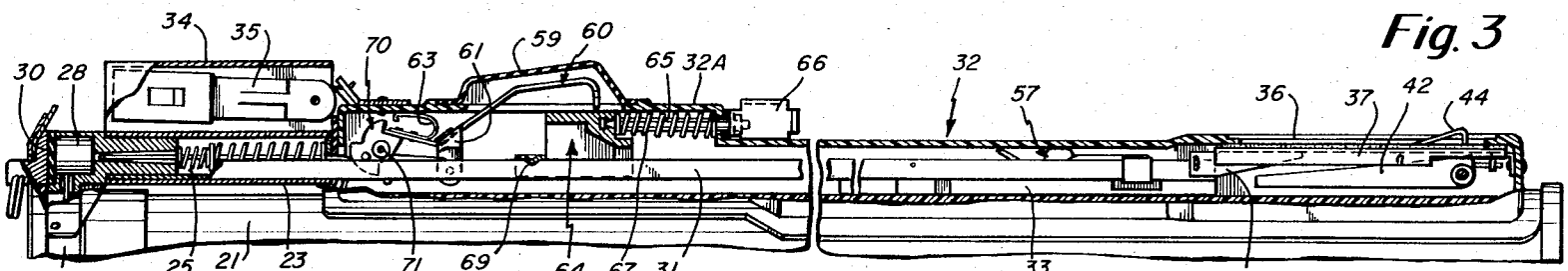
FIG. 3 is a longitudinal section, on an increase in scale, taken vertically through the firing mechanism with the launcher in its shortened state.
Figures 9, 10, 11, 12, 13:
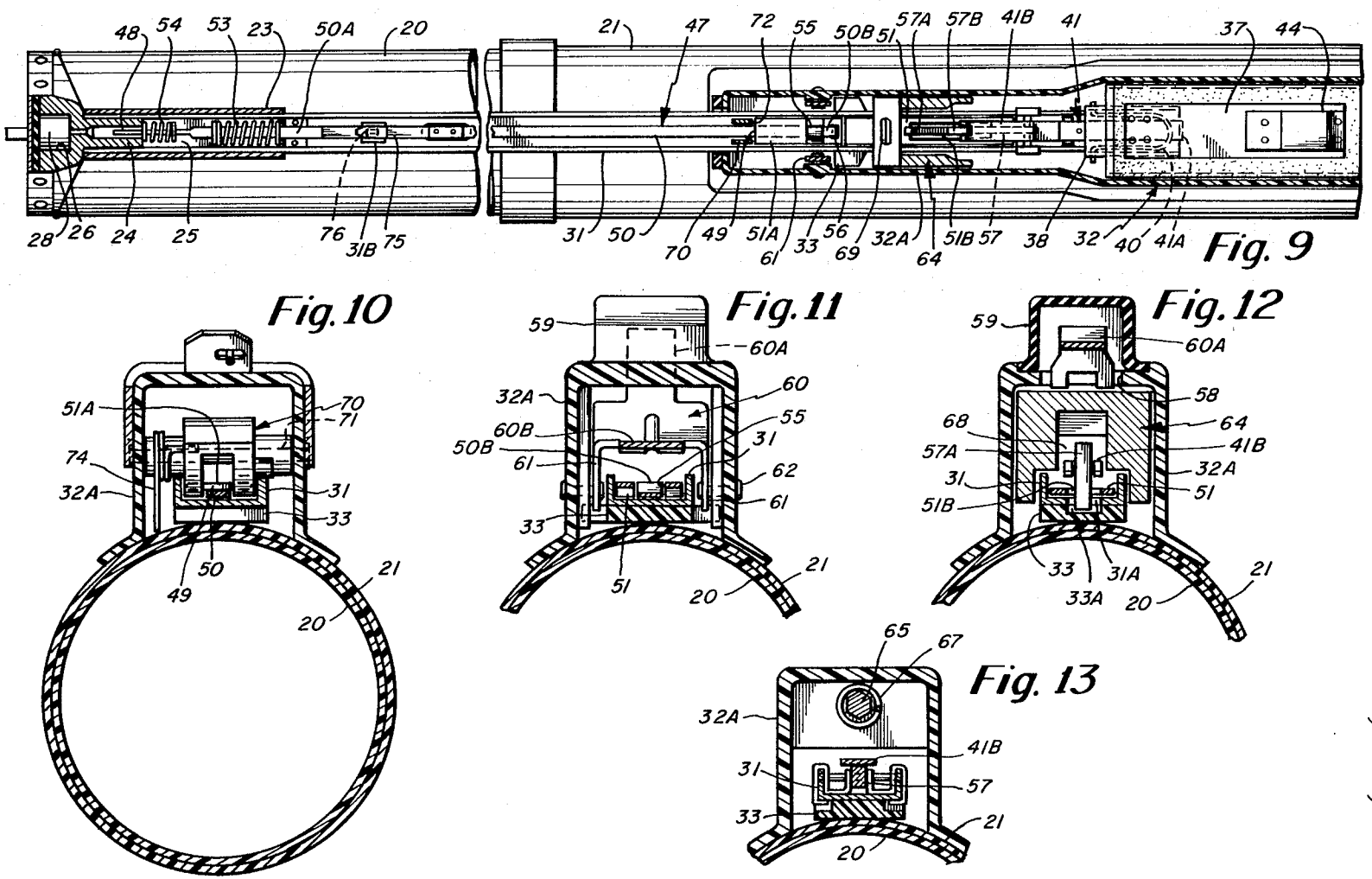
FIG. 9 is a section taken approximately along the indicated line 9—9 of 6.
FIG. 10 is a section taken approximately along the indicated line 10—10 of FIG. 7.
FIG. 11 is a section taken approximately along the indicated line 11—11 of FIG. 7.
FIG. 12 is a section taken approximately along the indicated line 12—12 of FIG. 7.
FIG. 13 is a section taken approximately along the indicated line 13—13 of FIG. 7.

The housing 23 supports one end of a rigid channel 31 which, see FIGS. 3, 6, and 9, extends freely into a housing, generally indicated at 32, fixed on the launcher section 21 and extending substantially the full length thereof with the rear portion of the housing 32 of an increased height and constituting a trigger chamber 32A. The forward end of the channel 31 is supported by and attached to a slide 33 resting on the section 21, see FIG. 4.

When the launcher is in its shortened state, the seal-carrying rear end of the chamber 32A butts against the housing 23 and a holder 34 mounted thereon. A rear sight 35 is pivotally connected to the rear end of the housing 32 in a manner such that it may extend into the holder 34 and is under the control of a spring, not shown, by which it is swung into its upright position of use once the launcher has been so extended that the rear sight has been pulled free from the holder 34.

Figure 4:
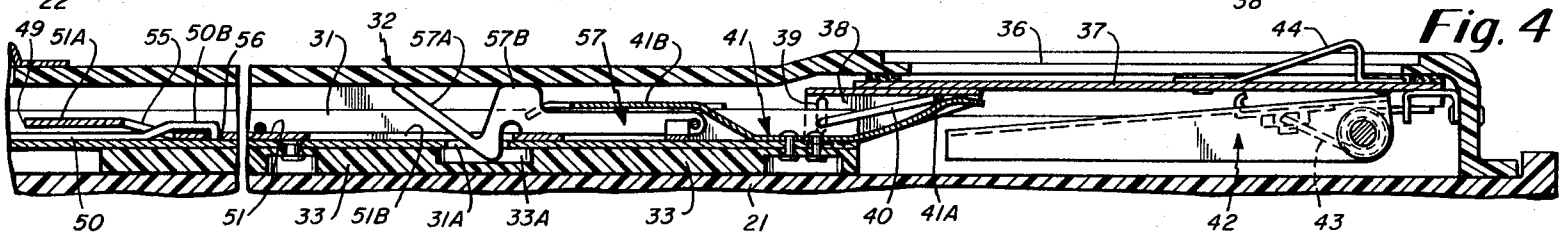
FIG. 4 is a like view, on a further increase in scale of the forward portion of the mechanism.

The housing 32 has a port 36, see FIG. 4, adjacent the front end of its upper surface and closed and sealed when the launcher is in its shortened, inoperative state by a plate 37 provided with a clip 38 having vertical slots 39 through which and the side walls of the channel 31 extend the ends of a U-shaped retainer 40. The plate 37 is yieldably held in its port-closing position by the forward end 41A of a spring 41 riveted to the channel 31 adjacent its front end. A front sight 42 is pivotally connected to the interior of the housing 32 adjacent the front end of the port 36 and is under the control of a spring 43 urging the front sight 42 into its erect, operative position in which it is backed by the front edge of the port 36. When the launcher is in its FIG. 2 state, the plate 37 overlies the front sight, see FIG. 4, but as the launcher is extended, the plate 37 is moved rearwardly relative to the port 36 until the front sight 42 is permitted to swing upwardly into its operative position, see FIG. 6.

THE FIRING MECHANISM

The firing mechanism has a firing member slidably supported by the channel 31 and generally indicated at 47. The firing member includes a firing pin 48 and features a transverse shoulder 49 above the rear end of the slide 33 in a position to be under the rear portion of the trigger chamber 32A when the launcher has been fully extended. These and other presently to be detailed features of the firing mechanism are conveniently established with the firing member consisting of a main portion 50 and a separate, forward section 51.

The main portion 50 is narrower than the channel 31 and is formed with a parallel rear end portion 50A, the extremity of which is shaped and dimensioned to establish the firing pin 48 and the end portion 50A raised relative to the channel 31 as required for its entry into the chamber 25 with the firing pin 48 extending into the bore 27. The end portion 50A within the chamber 25 has a flange 52 confining the firing spring 53 between it and the front wall of the chamber 25 and a rebound spring 54 between it and the partition 24. See FIGS. 5 and 8.

The extension 51 is wider than the main portion 50 and is a close but free fit within the channel 31. The connection between the main portion 50 and the extension 51 is established, see FIGS. 4, 7, and 9, by forming the extension 51 with a raised, parallel rear end 51A which overlies the forward end of the main part 50 and the rear edge of which constitutes the shoulder 49.

When the launcher is fully extended, a shoulder 44 on the plate 37 registers with a port 45 in the upper wall of the housing 32 and covered by a boot 46 and is brought into releasable locking engagement with the front edge thereof by the spring end 41A, see FIGS. 6 and 7, thus releasably locking the launcher section against lengthwise relative movement.

The extension 51 has a transverse slot 55 in the slope between it and the rear end 51A and a slot 56 forwardly of the slope. The forward end of the main portion is in the form of a hook 50B shaped and dimensioned to be inserted through the slot 55 and then caught in the slot 56 with both the main portion 50 and the extension 51 resting on the bottom of the channel 31.

The forward end of a rearwardly disposed latch 57 is pivotally connected to the forward end of the extension 51 of the firing member 51. The latch 57, see FIG. 4, includes a V-shaped hook 57A the apex of which, when the launcher is in its FIG. 2 position or state, extends through a slot 51B of substantial length in the extension 51, a port 31A in the channel 31 and into a socket 33A in the slide 33 thus to hold the firing member against movement in a firing direction. Upward movement of the latch 57 is blocked by the top wall of the housing 32.

The trigger chamber 32A has a port 58 covered by a boot 59. A trigger, generally indicated at 60 has side ears 61 pivotally connected as at 62 to the side walls of the chamber 32A, see FIG. 11. The trigger includes a forward portion 60A shaped to fit under the boot 59 with its free end downwardly turned and a rearward portion 60B engaged by a spring 63 yieldably maintaining the forward portion 60A in its raised position illustrated by FIGS. 3, 5, 6, and 7.

The forward trigger portion 60A is positively held in its raised position by a safety 64 slidably supported by the channel 31, see FIG. 12, with the downturned end of the trigger portion 60A in engagement therewith. The safety has a pull rod 65 extending through a sealed port in the front wall of the chamber 32A and provided with a finger grip 66. The safety 64 is yieldably held in its operative position by a spring 67.

Figures 14, 15, 16:
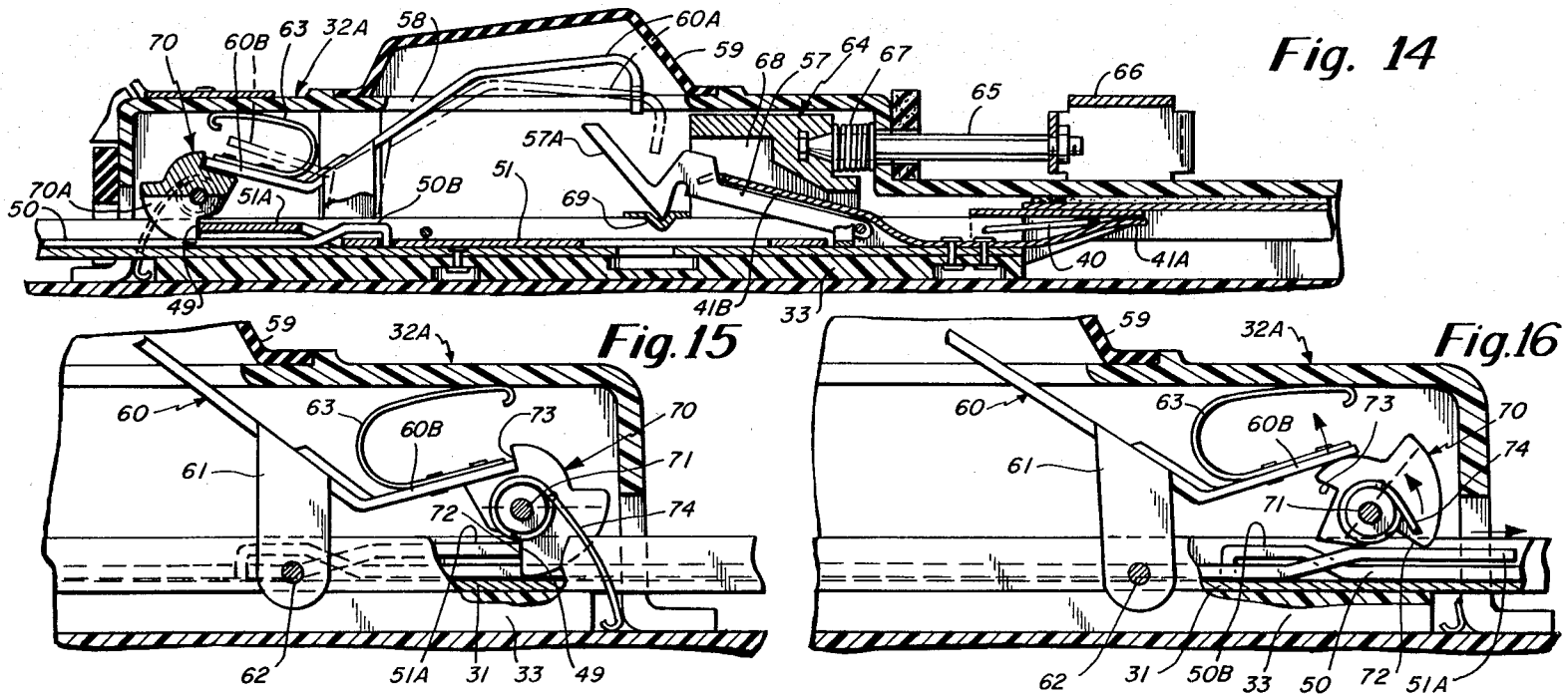
FIG. 14 is a view, similar to FIG. 7, but with the safety released.
FIG. 15 is a fragmentary view on an increase in scale of the sear with the firing member and the trigger in engagement with the sear shoulder.
FIG. 16 is a like view with the firing member released.

The safety 64 has a vertical slot extending from end-to-end thereof establishing a chamber 68, and, at its rear, a transverse detent 69. When the launcher is extended, see FIGS. 6 and 7, the latch 57 is within the trigger chamber 32A and under the safety chamber 68 with the extremity of the hook 57A forwardly of but above the detent 69. When the safety 64 is pulled forwardly, see FIG. 14, the detent cams the hook 57A upwardly out of engagement with the firing member extension 51 until it catches the apex thereof thus holding the safety in its "off" position unless the safety is pushed back manually. The rear portion 41B of the spring 41 yieldably holds the latch 57 in the detent 59.

In accordance with said U.S. Pat. No. 3,677,131, a rotary sear, generally indicated at 70, is mounted on a transverse shaft 71 supported by the side walls of the chamber 32A. The sear 70 has, see FIGS. 15 and 16, first and second arcuately spaced shoulders 72 and 73, respectively, with the second shoulder 73 engaged by the rearward trigger portion 60B and with the sear 70 under the control of a spring 74 yieldably maintaining the sear shoulder 73 in a position for engagement therewith. The sear is of a width enabling it to enter the channel 31 and is slotted as at 70A to straddle the main portion 50 of the firing member and dividing the first shoulder 72 which is engaged by the shoulder 49.

When the launcher requires but a predetermined short further relative movement between the sections 20 and 21 to effect full extension, the shoulder 49 is engaged by the divided first shoulder 72 of the sear which is held against turning by the trigger 60 with the result that the firing member is pulled forwardly, tensioning the firing spring 53 and once the launcher is fully extended, cocking and holding cocked the firing mechanism.

With the safety 64 pulled forwardly, the trigger 60 may be actuated to release the firing mechanism. Another function of the sear 70 is that it allows the launcher to be re-cocked in the event of a misfire of the primer. To effect the re-cocking, the detent 46 is released and the launcher sufficiently shortened to move the firing pin extension 51 forwardly relative to the sear 70 so that the sear will rotate under the influence of the sear spring 74 in a direction opposite to the direction of the arrow in FIG. 16 back to the sear position illustrated by FIG. 15 with re-extension of the launcher bringing the sear shoulder 72 in engagement with the shoulder 49 of the firing member and the sear shoulder 73 in engagement with the trigger portion 60B.

It will be noted that even when the launcher is in its shortened state, the firing member is locked. An additional safety may be provided. As shown in FIGS. 5 and 8, the shaft 71 of the sear 70 has ridden up the slope of a rearwardly disposed spring arm 75 attached to the main portion 50A of the firing member and in so doing has forced a lock pin 76 downwardly through a subjacent hole in that portion into a hole 31B in the channel 31 thereby to prevent any material movement of the firing member even if the launcher is dropped or otherwise subjected to a substantial jolt when in its shortened, inoperative position.

As thus far described, the firing means is or may be substantially the same as that disclosed in said patent and the operation of the launcher will be apparent from the foregoing.

Figure 17:
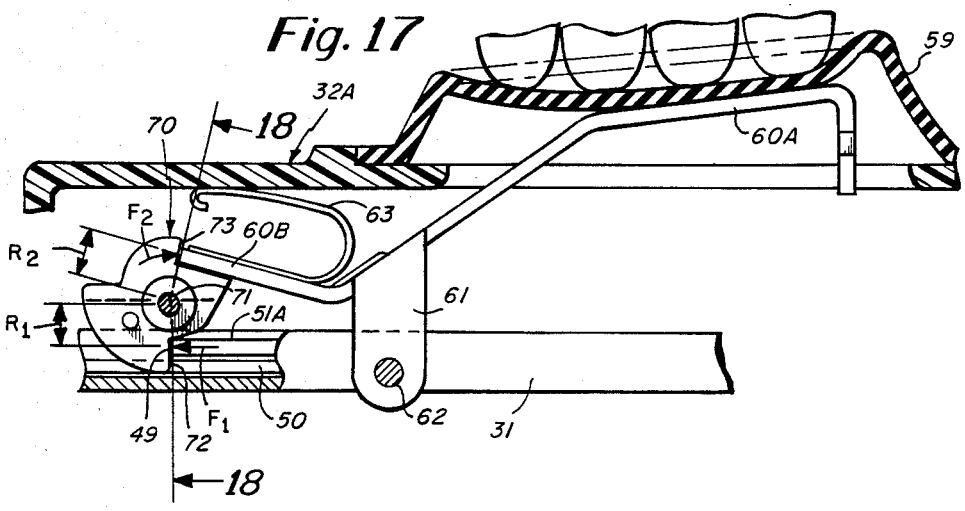
FIG. 17 is a side view of the rotary sear.
Figure 18:
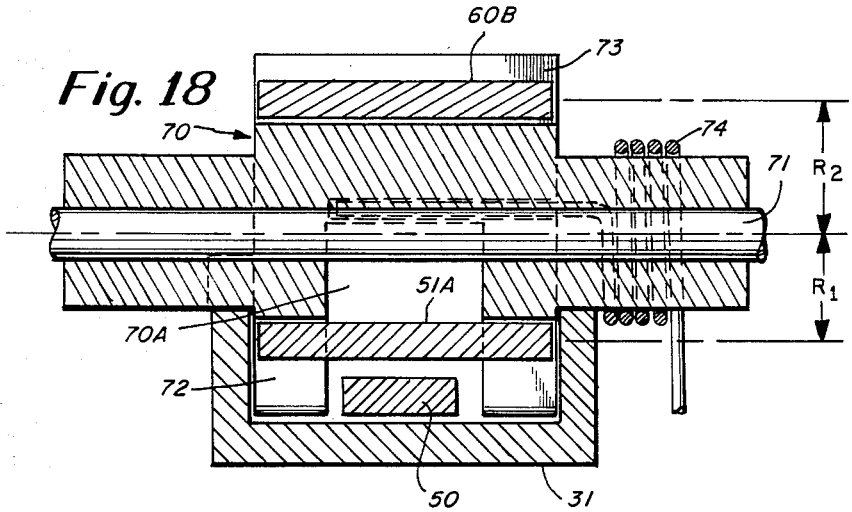
FIG. 18 is an end view thereof.

It will be appreciated that when the launcher is cocked by the full extension thereof, that a force, see FIG. 17, is exerted against the sear shoulder 72 which, in practice is thirteen pounds for one example and this same force F1 is exerted against the trigger. In the disclosed embodiment of the invention, the length of the trigger portion 60A is approximately twice that of the rearward section 60B. With the resulting 2:1 mechanical advantage, the force required to operate was assumed to be in an acceptable range. In applying trigger-releasing force or pressure, the accepted mode is to so hold the launcher that with the launcher resting on a shoulder, one hand holds the launcher near the muzzle while the four fingers of the other hand engage the boot and all are used in exerting the force necessary to disengage the trigger from the sear, the firing member then being driven rearwardly by the firing spring. While the release is suitably crisp and the firing spring is strong enough to prevent any drag, the range of trigger-releasing forces was found to so vary that the required aiming accuracy could not be attained.

In accordance with the present invention this objectionable feature is eliminated without requiring any change in the above described weapon other than in the sear 70. The reason why inaccuracy in use resulted arises from the fact that with the necessary way in which the trigger operating pressure is applied through the boot, the actual place along the trigger portion 57A where the applied force was effective varied and usually with a mechanical advantage substantially less than 2:1 making the trigger pull far too heavy as well as variable. This result is avoided by so forming the sear that the force F1 is applied against a smooth and uniform sear shoulder 72 at a point a selected distance R1 from the sear axis that is less than the point at which force F2 is applied against the shoulder 73, a distance R2 with, for example, a ratio of 2:3, the force F2 is reduced to about nine pounds and the trigger-releasing force within the acceptable range of from six to eight pounds, or whatever other operating pressure range or spread is desired or required, unavoidably varying due to the impossibility of being able to apply effective force digitally to the same place along the trigger portion 57A with any degree of uniformity.

I claim:

1. A projectile launcher including breech and muzzle sections telescopingly connected to enable the launcher to have shortened inoperative and extended operative states, a housing on the muzzle section, firing mechanism including a firing member and a firing spring, said firing member movable between a forward cocked position in which the firing spring is tensioned and a rearward firing position, said firing member extended freely into said housing and provided with a transverse shoulder, said housing having a boot covered port adjacent the rear end thereof, a trigger pivotally mounted in said housing and including a forward portion under said port and a rear portion, a sear rotatably mounted in said housing and having first and second arcuately spaced shoulders, a spring within said housing urging said trigger into a first position in which the forward portion may be depressed by pressure applied thereto through the boot by fingers of one hand and the rear trigger portion holding the second shoulder against sear rotation in one direction until said forward portion is depressed, a spring within said housing and connected to the sear to effect rotation thereof in a direction such that the second shoulder is yieldably held in engagement with the rear portion of the trigger, the first shoulder then held in a position to be engaged by the transverse shoulder of the firing member, when the launcher is so extended that but short further extension is required to establish said operative state and said forward cocked position of said firing member, at the end of said short further extension, said tensioned firing spring then exerting substantial force against said first sear shoulder, said shoulders so dimensioned that the end of the trigger in engagement with the second shoulder is at a radial distance from the axis of the sear which is greater than the radial distance between the shoulder of the firing member when in engagement with the first sear shoulder.

2. The projectile launcher of claim 1 in which the ratio between the radial distance between the rear end of the trigger when held by the second sear shoulder and the sear axis and the radial distance between the transverse shoulder when held by the first shoulder of the sear and the sear axis is approximately 3:2.

* * * * *